United States Patent [19]

Lee

[11] Patent Number: 4,734,544

[45] Date of Patent: Mar. 29, 1988

[54] SIGNAL CABLE HAVING AN INTERNAL DIELECTRIC CORE

[76] Inventor: Noel Lee, 47 West Park Dr., Daly City, Calif. 94015

[21] Appl. No.: 925,809

[22] Filed: Oct. 29, 1986

[51] Int. Cl.[4] ..... H01B 7/08

[52] U.S. Cl. ..... 174/117 F; 174/113 C; 174/115; 174/131 A

[58] Field of Search ..... 174/113 C, 131 A, 117 R, 174/117 F, 115

[56] References Cited

U.S. PATENT DOCUMENTS

| | | | |
|---|---|---|---|
| 1,211,153 | 1/1917 | Hochstadter | 174/115 |
| 1,727,971 | 9/1929 | Ford | 174/112 |
| 2,302,839 | 11/1942 | Burgett | 174/113 C |
| 2,455,773 | 12/1948 | Johnson | 174/117 R |
| 2,978,530 | 4/1961 | Braeckman | 174/34 |
| 3,102,160 | 8/1963 | Cook et al. | 174/34 |
| 3,261,907 | 7/1966 | Morrison | 174/115 |
| 3,355,544 | 11/1967 | Costley et al. | 174/106 R |
| 3,602,632 | 8/1971 | Ollis | 174/36 |
| 3,758,704 | 9/1973 | Naud | 174/115 X |
| 3,772,454 | 11/1973 | Donecker et al. | 174/115 X |
| 3,815,054 | 6/1974 | McClure et al. | 174/113 R X |
| 4,131,757 | 12/1978 | Felkel | 174/107 |
| 4,158,185 | 6/1979 | Dageforde et al. | 174/113 R X |
| 4,250,351 | 2/1981 | Bridges | 174/106 R |
| 4,449,012 | 5/1984 | Voser | 174/117 F X |
| 4,486,623 | 12/1984 | Ploppa | 174/113 C X |
| 4,538,023 | 8/1985 | Brisson | 174/115 |

FOREIGN PATENT DOCUMENTS

| | | | |
|---|---|---|---|
| 2306386 | 8/1974 | Fed. Rep. of Germany | 174/117 F |
| 572618 | 11/1923 | France . | |
| 834353 | 11/1938 | France | 174/117 F |
| 1366343 | 12/1964 | France | 174/117 F |
| 592492 | 5/1959 | Italy | 174/131 R |
| 2049262 | 12/1980 | United Kingdom . | |

*Primary Examiner*—Morris H. Nimmo
*Attorney, Agent, or Firm*—Warren B. Kice

[57] ABSTRACT

A cable in which a dielectric core is surrounded by a plurality of bundles of wire strands with the wire strands forming each bundle being twisted in a first direction and the bundles being twisted around the solid conductor in a direction opposite the first direction. Insulation means extend around the bundles of wire strands. A pair of cables configured in the above manner are provided to carry the positive and negative signals between a power source and a load.

1 Claim, 2 Drawing Figures

SIGNAL CABLE HAVING AN INTERNAL DIELECTRIC CORE

BACKGROUND OF THE INVENTION

This invention relates to a cable and a cable assembly, and, more particularly, to a cable and a cable assembly for transmitting an electrical signal between a power source and a load.

Various types of cables have been used to transfer electrical current, in some form of signal, between a power source and a load. For example, the signal from an audio amplifier is transmitted by a cable to a loudspeaker for producing a replica of a signal from a program source that is introduced to the amplifier. However, there is much controversy as to the optimum type of cable that should be used in this environment.

SUMMARY OF THE INVENTION

It is an object of the present invention to provide a signal cable in which a plurality of bundles of wire strands are provided which carry the signal and which surround a dielectric core.

It is a further object of the present invention to provide a signal cable of the above type in which the bundles of wire strands are twisted into a rope-lay configuration and wrapped around the dielectric core.

It is a still further object of the present invention to provide a cable assembly formed by two cables of the above type which is relatively flexible and thus easy to handle and install.

Toward the fulfillment of these and other objects, the cable of the present invention includes a plurality of bundles of wire strands, twisted into a rope-lay configuration, wrapped around a dielectric core and disposed within an insulation.

DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawings wherein.

DESCRIPTION OF THE PREFERRED EMBODIMENT

Figure 1:
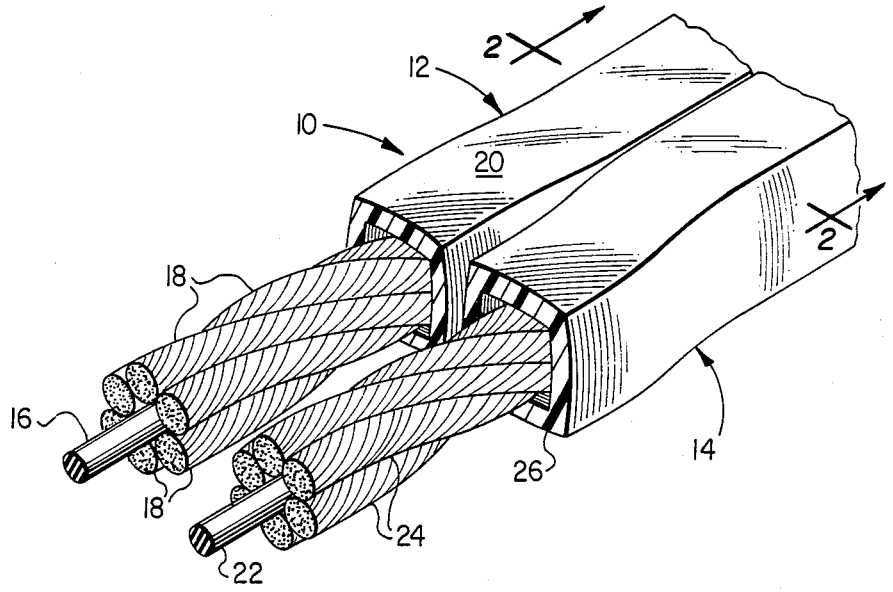
FIG. 1 is a partial perspective view depicting a signal cable of the present invention, with the insulation portion of the cable being removed from the end portions thereof for convenience of presentation.

Referring specifically to the drawings the reference numeral 10 refers in general to the signal cable assembly of the present invention which comprises a first cable 12 extending in a juxtaposed, parallel relationship to a second cable 14.

The cable 12 is formed by a central, solid, rod-like dielectric core 16 surrounded by a plurality of bundles 18 of wire strands. The bundles 18 are twisted about the core 16 and, as shown by the curved lines, the wire strands forming each bundle 18 are twisted in a direction opposite that of the direction of twist of the bundles around the core 16.

An insulating sleeve 20 extends around the bundles 18 and is fabricated of an insulating material such as plastic or rubber and has a substantially rectangular cross section.

In a similar manner, the cable 14 comprises a dielectric core 22 which is surrounded by a plurality of bundles 24 of wire strands. The bundles 24 are twisted around the core 22 in a direction opposite to that of the twist of the wire strands forming each bundle. An insulating sleeve 26 extends around the twisted bundles 24.

Figure 2:
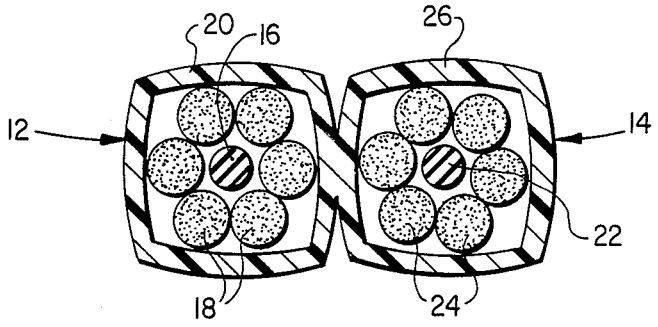
FIG. 2 is a cross-sectional view taken along the line 2—2 of FIG. 1.

The cores 16 and 22 are fabricated from a dielectric material such as polypropylene and the wire strands forming the bundles 18 and 24 are of a current carrying material, such as copper. The wire strands are of a relatively thin gauge such as 36 gauge (AWG) and, according to a preferred embodiment, are formed into six bundles with each bundle consisting of approximately forty-eight strands. The wire strands of each bundle are wound approximately one turn per inch and the bundles 18 and 24 are wound approximately three turns per inch around their respective cores 16 and 22. As shown in FIG. 2 the sleeves 20 and 26 are disposed in a juxtaposed parallel relationship with their corresponding sidewall portions being molded together.

In FIG. 1, the insulating sleeves 20 and 26 of the cables 12 and 14, respectively, have been removed from the end portions of cables to show the uninsulated end portions of each cable which are connected to a power source and/or load. One of the cables 12 or 14 can carry the positive signal and the other can carry the negative signal with the respective uninsulated ends of each cable being connected, via conventional connectors, such as spade lugs, banana plugs, or the like, to the positive and negative terminals of the power source and load. The bundles 18 thus together function as one conductor and the bundles 24 function together as one conductor, it being understood that, since the dielectric cores 16 and 22 are nonconductive they are not connected to the power source or load.

As an alternative embodiment, in order to reduce costs the dielectric cores 16 and 22 can be replaced by a wire or conductor surrounded by insulation and nonterminated as discussed above.

Several advantages result from the foregoing. For example, by virtue of the opposite twisting of the wire strands forming each bundle and the bundles themselves in combination with the dielectric core, a cable is provided which is flexible and easy to handle and install.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the spirit and scope of the invention therein.

What is claimed is:

1. A signal cable assembly comprising:

a first cable adapted to carry the positive signal between a power source and a load, said first cable comprising:

an elongated, uninsulated, rod-like solid dielectric material;

a plurality of bundles of wire strands of conductive material twisted around said dielectric material for collectively carrying said positive signal, the wire strands forming each bundle being twisted in a first direction and the bundles being twisted around said dielectric material in a direction opposite said first direction; and insulation means extending around said bundles of wire strands; and a second cable adapted to carry the negative signal between said power source and said load, said second cable comprising:

an elongated, uninsulated, rod-like solid dielectric material;

a plurality of bundles of wire strands of conductive material twisted around said dielectric material for collectively carrying said negative signal, the wire strands forming each bundle being twisted in a first direction and the bundles being twisted around said dielectric material in a direction opposite said first direction; and insulation means extending around said bundles of wire strands;

said first and second cables being disposed in a juxtaposed parallel relationship with their respective insulation means molded together.

* * * * *